US008782838B2

(12) United States Patent
Honeycutt et al.

(10) Patent No.: US 8,782,838 B2
(45) Date of Patent: Jul. 22, 2014

(54) FALL RESTRAINT EQUIPMENT COMPONENT AND METHOD FOR MANUFACTURING THE SAME

(75) Inventors: Robert W. Honeycutt, Pawleys Island, SC (US); Thomas A. Mefferd, Mt. Pleasant, SC (US)

(73) Assignee: Safe Rack, LLC, Andrews, SC (US)

( * ) Notice: Subject to any disclaimer, the term of this patent is extended or adjusted under 35 U.S.C. 154(b) by 0 days.

(21) Appl. No.: 12/487,408

(22) Filed: Jun. 18, 2009

(65) Prior Publication Data

US 2010/0031455 A1 Feb. 11, 2010

Related U.S. Application Data

(60) Provisional application No. 61/087,732, filed on Aug. 10, 2008.

(51) Int. Cl.

| | |
|---|---|
| ***E01D 1/00*** | (2006.01) |
| ***E06C 7/18*** | (2006.01) |
| ***E04H 17/00*** | (2006.01) |

(52) U.S. Cl.

USPC ..... 14/69.5; 182/106; 256/65.04

(58) Field of Classification Search

USPC ..... 14/69.5, 71.1; 182/106, 228.1, 2.1, 2.2, 182/21; 256/65.02, 65.03, 65.04, 65.05, 256/65.06, 65.07

See application file for complete search history.

(56) References Cited

U.S. PATENT DOCUMENTS

| | | | | |
|---|---|---|---|---|
| 309,320 | A | 12/1884 | Stockbridge | |
| 540,192 | A | 5/1895 | Rosback | |
| 903,157 | A | 11/1908 | Allen | |
| 981,613 | A | 1/1911 | Carter | |
| 1,353,073 | A * | 9/1920 | Schivins | 256/65.02 |
| 1,505,116 | A | 8/1924 | Wiebe | |
| 1,815,048 | A | 7/1931 | Chambers | |
| 1,944,159 | A | 1/1934 | Bailey | |
| 2,326,844 | A | 8/1943 | Ely | |
| 3,095,848 | A * | 7/1963 | Dick | 114/230.1 |
| 3,869,109 | A | 3/1975 | Russo | |
| 4,072,294 | A | 2/1978 | Densen | |
| 4,106,150 | A | 8/1978 | Irwin | |
| 4,133,283 | A * | 1/1979 | Ryan | 114/230.18 |
| 4,149,701 | A | 4/1979 | Densen | |
| 4,154,318 | A | 5/1979 | Malleone | |

(Continued)

FOREIGN PATENT DOCUMENTS

| | | |
|---|---|---|
| GB | 2275632 | 9/1994 |

OTHER PUBLICATIONS

PCT International Search Report and Written Opinion of the International Searching Authority dated Feb. 6, 2009 for PCT/US2008/85922 filed on Dec. 8, 2008, corresponding to co-pending U.S. Appl. No. 12/329,883.

(Continued)

*Primary Examiner* — Abigail A Risic

(74) *Attorney, Agent, or Firm* — Nelson Mullins Riley & Scarborough

(57) ABSTRACT

Uprights and lateral or connecting posts to be used in conjunction with a gangway or other fall restraint equipment where the uprights and posts are created by cutting portions of integral, continuous pieces of tubular metal rather than welding smaller pieces of stock material together. Sidepost assemblies or handrails are created by connecting the uprights and posts together.

22 Claims, 11 Drawing Sheets

(56) References Cited

U.S. PATENT DOCUMENTS

| | | | | |
|---|---|---|---|---|
| 4,161,795 | A | 7/1979 | Quest | |
| 4,168,764 | A | 9/1979 | Walters | |
| 4,280,243 | A | 7/1981 | Durrant | |
| 4,335,803 | A * | 6/1982 | Sugita | 182/12 |
| 4,712,264 | A | 12/1987 | Voith | |
| 4,768,497 | A | 9/1988 | Winge | |
| 4,838,735 | A * | 6/1989 | Warner | 405/220 |
| 5,010,614 | A | 4/1991 | Braemert et al. | |
| 5,077,852 | A | 1/1992 | Karlsson | |
| 5,097,787 | A | 3/1992 | Bruce | |
| 5,319,818 | A | 6/1994 | Baranowski | |
| 5,402,546 | A | 4/1995 | Baranowski | |
| 5,794,292 | A | 8/1998 | Ricci, Jr. | |
| 5,950,266 | A * | 9/1999 | Streeter et al. | 14/69.5 |
| 5,994,667 | A | 11/1999 | Merdan et al. | |
| 6,036,177 | A * | 3/2000 | Kirkwood, Jr. | 256/59 |
| 6,170,609 | B1 | 1/2001 | Dech | |
| 6,425,572 | B1 | 7/2002 | Lehr | |
| 6,526,614 | B2 * | 3/2003 | Anderson et al. | 14/69.5 |
| 6,813,792 | B2 * | 11/2004 | Miller | 14/69.5 |
| 6,923,140 | B1 * | 8/2005 | Cook | 114/362 |
| 7,010,825 | B1 * | 3/2006 | Finch Salas et al. | 14/72.5 |
| 7,159,261 | B2 | 1/2007 | Carrigan | |
| 7,309,844 | B2 * | 12/2007 | Lajoie | 219/137.31 |
| 7,383,600 | B2 | 6/2008 | Carrigan | |
| 2002/0066290 | A1 | 6/2002 | Chen | |
| 2002/0189177 | A1 | 12/2002 | Eve et al. | |
| 2004/0107519 | A1 * | 6/2004 | Grody | 14/69.5 |
| 2007/0161460 | A1 | 7/2007 | Katz et al. | |
| 2007/0278041 | A1 | 12/2007 | Cosgrove | |
| 2009/0144916 | A1 * | 6/2009 | Honeycutt et al. | 14/71.1 |
| 2010/0031455 | A1 | 2/2010 | Honeycutt et al. | |
| 2010/0031456 | A1 | 2/2010 | Honeycutt | |
| 2010/0032633 | A1 | 2/2010 | Honeycutt et al. | |

OTHER PUBLICATIONS

PCT International Search Report and Written Opinion of the International Searching Authority dated Sep. 24, 2009 for PCT/US2009/053285 filed on Aug. 10, 2009, corresponding to co-pending U.S. Appl. No. 12/468,704.

PCT International Search Report and Written Opinion of the International Searching Authority dated Sep. 24, 2009 for PCT/US2009/053299 filed on Aug. 10, 2009, corresponding to co-pending U.S. Appl. No. 12/487,408.

PCT International Search Report and Written Opinion of the International Searching Authority dated Sep. 28, 2009 for PCT/US2009/053313 filed on Aug. 10, 2009, corresponding to co-pending U.S. Appl. No. 12/537,842.

Office Action issued by the U.S. Patent and Trademark Office on Aug. 13, 2010 for copending U.S. Appl. No. 12/329,883, filed Dec. 8, 2008.

Office Action issued by the U.S. Patent and Trademark Office on Jun. 12, 2012 for co-pending U.S. Appl. No. 12/537,842.

* cited by examiner

FALL RESTRAINT EQUIPMENT COMPONENT AND METHOD FOR MANUFACTURING THE SAME

CLAIM OF PRIORITY

The present application claims the benefit of the United States provisional patent application filed on Aug. 10, 2008 by Robert W. Honeycutt for COMPONENTS OF SAFETY EQUIPMENT AND METHODS FOR MANUFACTURING THE SAME (Ser. No. 61/087,732), the entire disclosure of which is incorporated by reference as if set forth verbatim herein.

FIELD OF THE INVENTION

The present invention relates generally to fall restraint equipment components. More particularly, the present invention relates to posts for gangways.

BACKGROUND OF THE INVENTION

FIG. 1 illustrates an example of fall restraint equipment comprising a stairwell 16, a platform 18, and a gangway 10. Stairwell 16 ascends to platform 18, where gangway 10 is connected. An optional cage 20 may be connected to gangway 10 if desired. In this example, the fall restraint equipment provides a user with access to a top 14 of a container 12 (such as a railway car).

FIG. 2 illustrates a gangway 200 that may be used as gangway 10 of FIG. 1. Gangway 200 comprises a base tread 202, which includes two posts or "uprights" 204 connected to base tread support 206. Uprights 204 are preferably welded to base tread support 206 but may be connected to the support by other suitable means, such as by bolting. Base tread 202 is conventionally connected to a fixed structure, such as platform 18 (FIG. 1). An support structure or "underbody" 208 is pivotally connected to base tread support 206 at one end and is pivotally connected to another tread 210, such as a seatainer tread, at the other end. Seatainer tread 210 is comprised of uprights 212 and 214 connected to each side of a tread support 216. Each set of uprights 212 and 214 are interconnected by lateral posts 218 and 220. Lateral posts 218 and 220 may be referred to as "joiners," "connectors," or "spacer tubes." In this example, gangway 200 additionally comprises a pair of self-leveling supports 222 pivotally connected to underbody 208. Uprights 212 include top portions 226 that are configured to pivotally receive respective portions of a pair of handrails 224. Likewise, uprights 204 are configured to pivotally receive opposite ends of handrails 224. Gangway 200 may comprise additional components, such as a pair of supports, handrails, or "blocking rails" 228, as desired or needed.

The pivotal connections between underbody 208 and base tread 202, self-leveling supports 222, and seatainer tread 210 enable gangway 200 to rotate with respect to a fixed structure, such as platform 18 (FIG. 1). Additionally, the pivotal connections between uprights 204 and top portions 226 of uprights 212 allow seatainer tread 210 to rotate with respect to base tread 202.

Components of fall restraint equipment, such as gangways, are generally formed by welding smaller pieces of stock material together. For instance, top portions 226 of uprights 212 are formed by welding various pieces of stock material together, which are drilled or cut prior to welding. Portions 226 are then welded to a tubular piece of metal. Other areas of uprights 212 are then formed in a similar manner. For example, the portions that connect the uprights to tread support 216 are likewise formed from smaller pieces of metal that have been cut and welded together. These portions are then welded to the bases of the tubular metal of uprights 212 in order to form the complete upright. Once uprights 212 and 214 have been created in this manner, respective ends of lateral posts 218 and 220 are welded to the uprights. Manufacturing components for fall restraint equipment in such a manner is a protracted process and increases the cost of the finished product.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
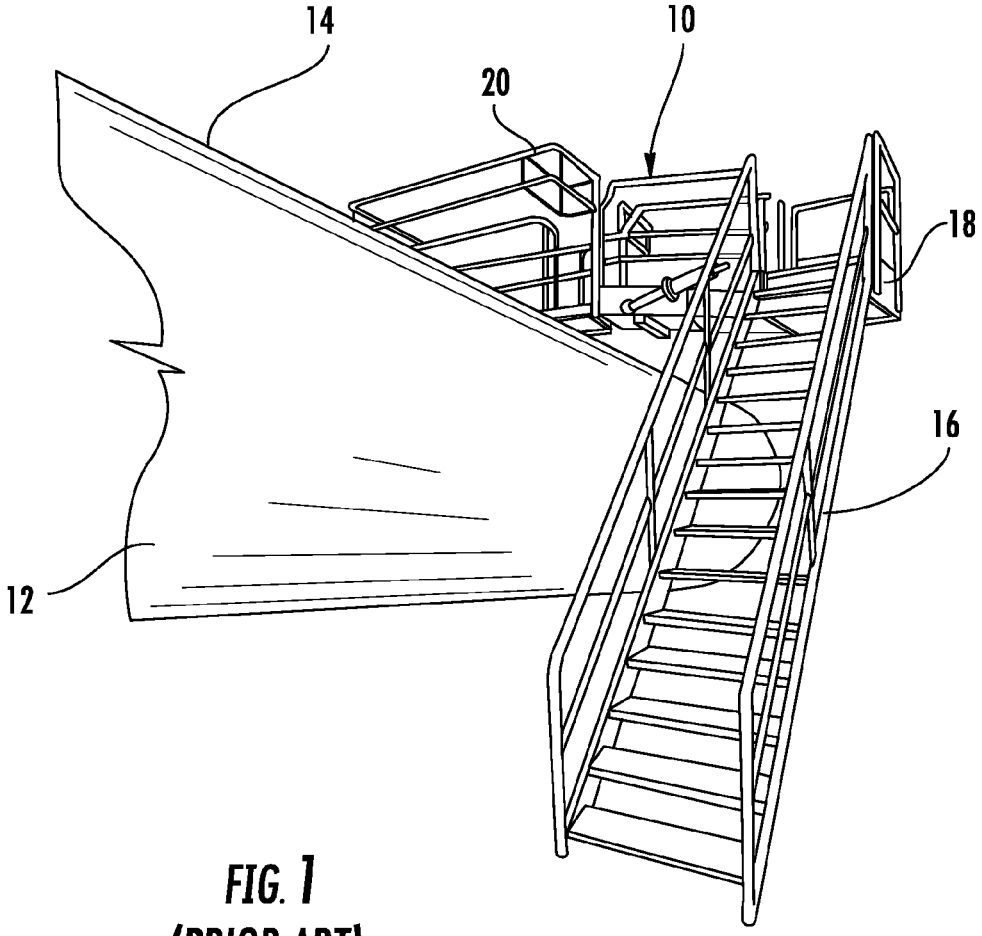
FIG. 1 (PRIOR ART)
FIG. 1 is a perspective view of an exemplary fall restraint system.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 3:
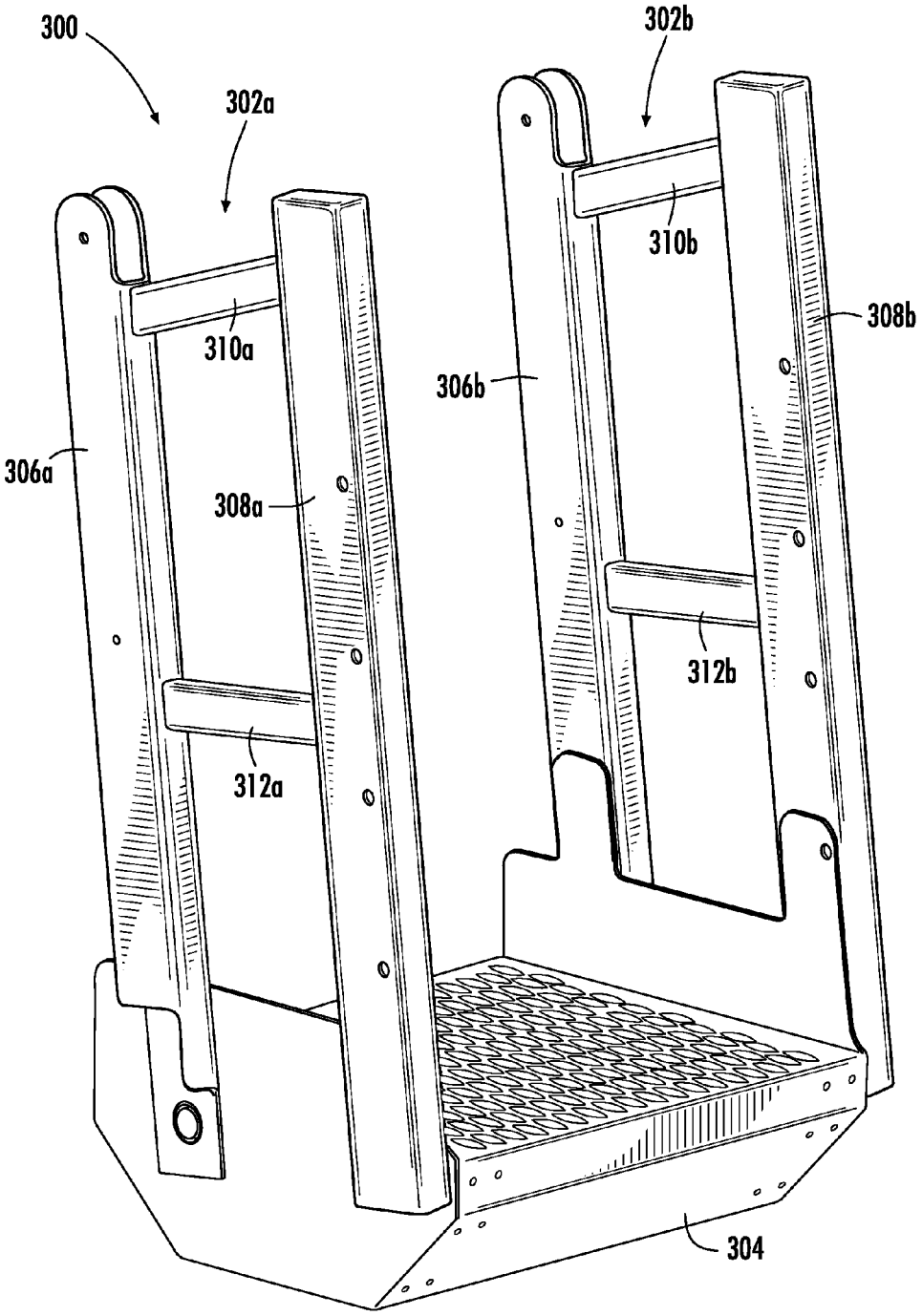
FIG. 3 is a perspective view of a seatainer tread of a gangway in accordance with an embodiment of the present invention.

FIG. 3 illustrates a seatainer tread 300, which may be substituted for the seatainer tread 210 of gangway 200 (FIG.

2). Additional information regarding the construction and operation of gangways is contained in U.S. patent application Ser. No. 12/329,883, the entire disclosure of which is hereby incorporated by reference as if set forth verbatim herein. Seatainer tread 300 comprises two sidepost assemblies or handrails 302 connected to respective sides of support tread 304. Each handrail 302 comprises a first post or upright 306 and a second post or upright 308 interconnected by lateral posts 310 and 312.

Figure 2:
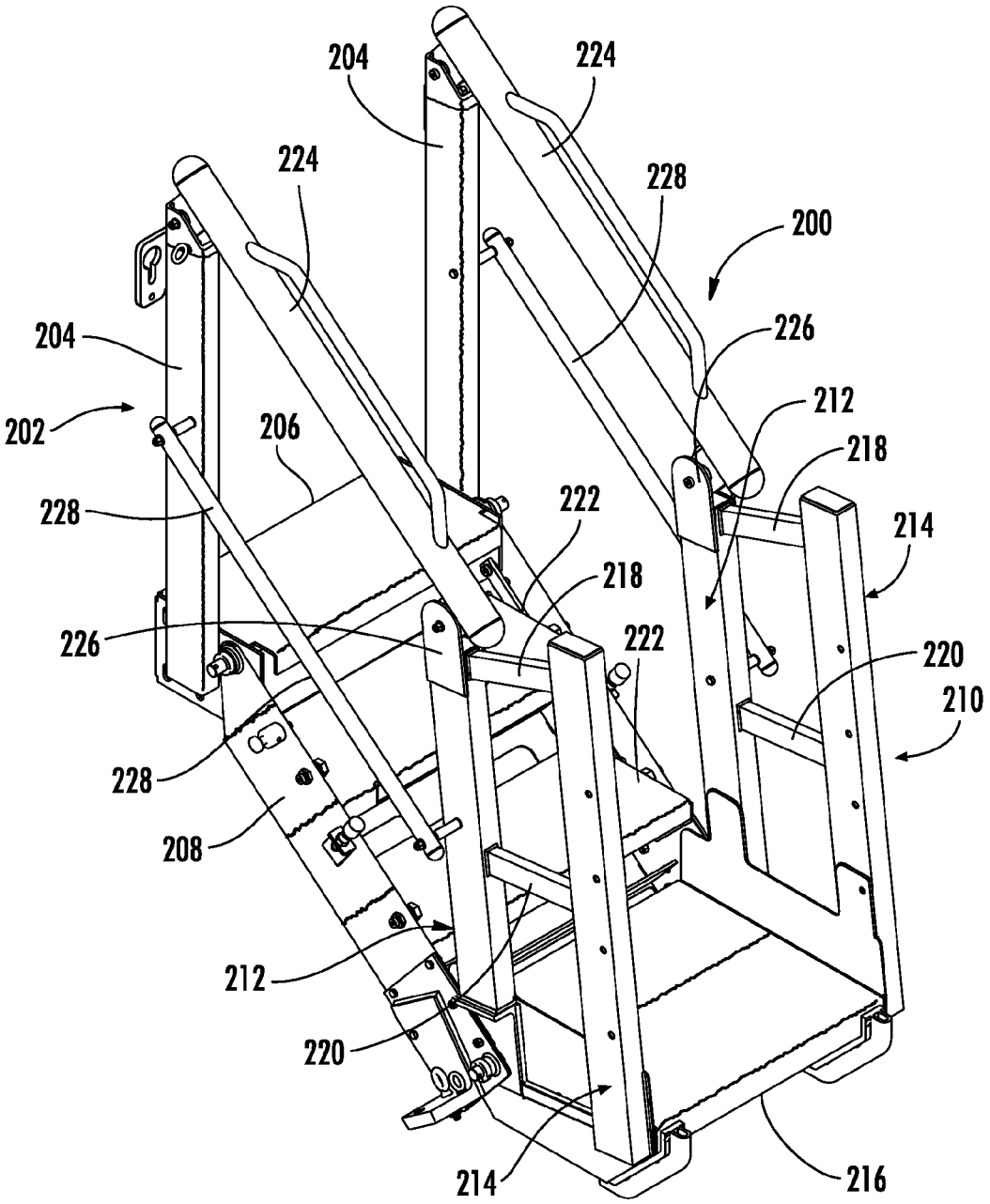
FIG. 2 (PRIOR ART)
FIG. 2 is a perspective view of a gangway that may have been used in the system of FIG. 1.
Figure 4:
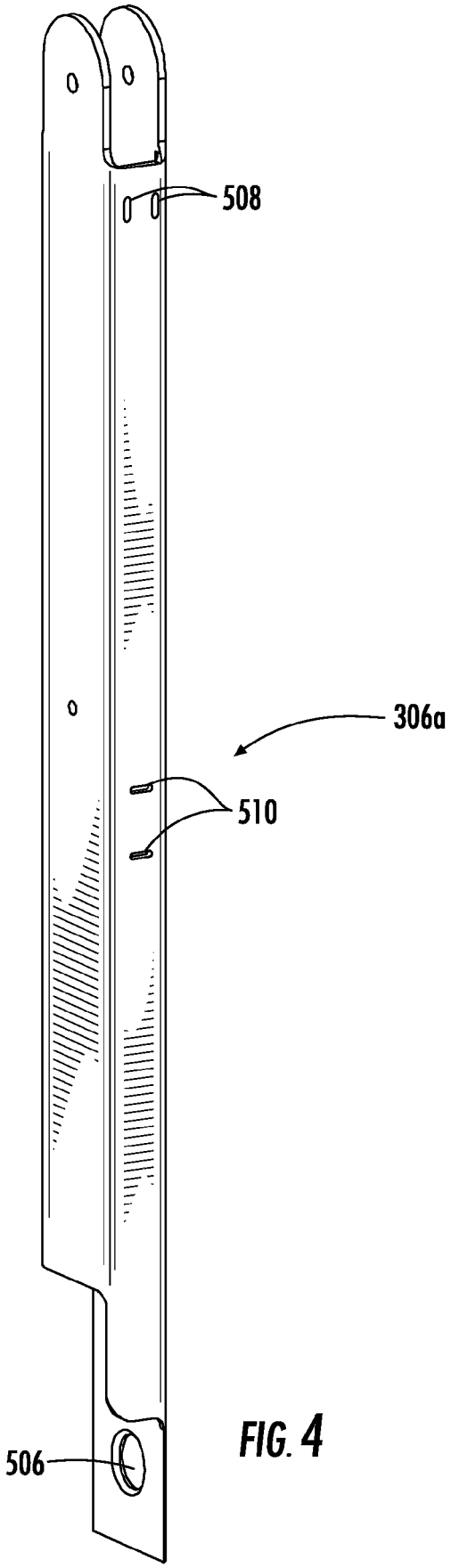
FIG. 4 is a perspective view of an upright to be used in conjunction with the seatainer tread of FIG. 3.
Figure 5:
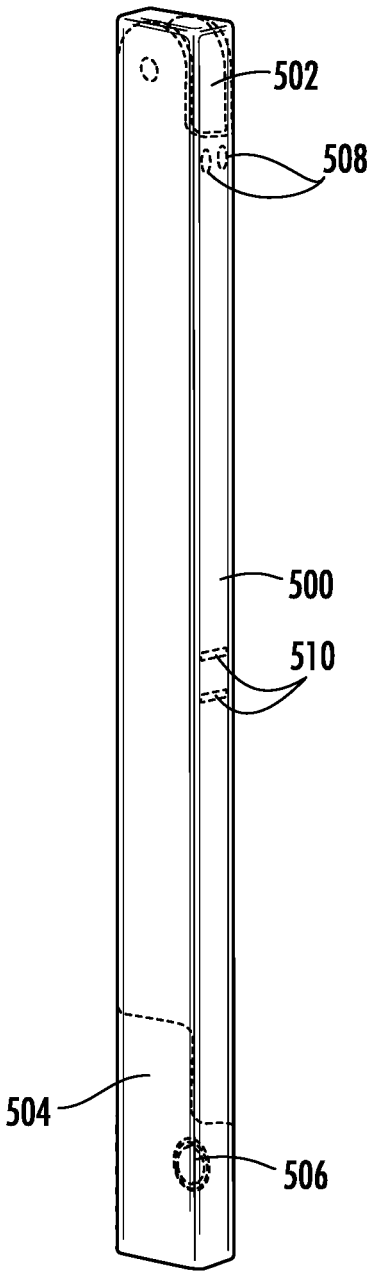
FIG. 5 is a perspective view of a continuous piece of tubular metal to be formed into the upright of FIG. 4.
Figure 6:
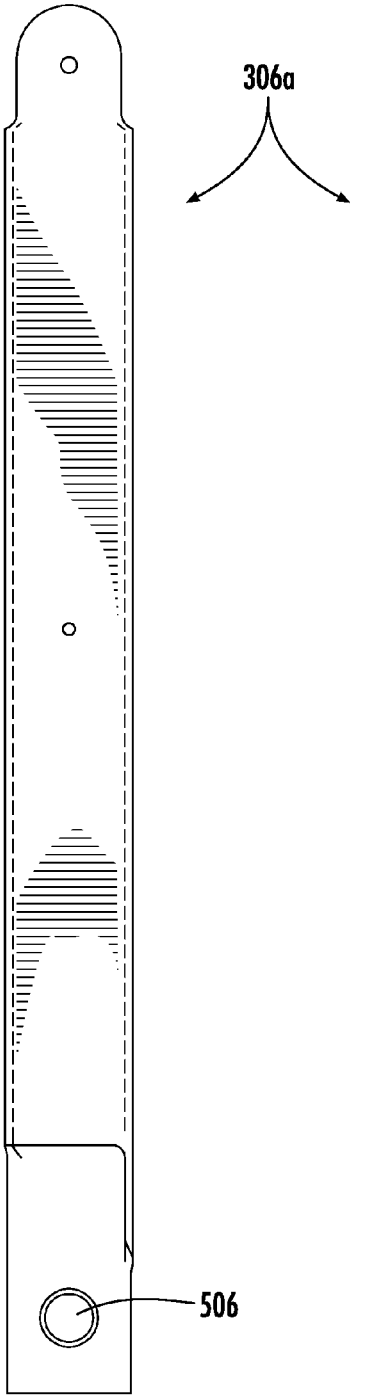
FIGS. 6, 7, and 8 are left side, front, and back elevation views, respectively, of the post of FIG. 4.
Figure 7:
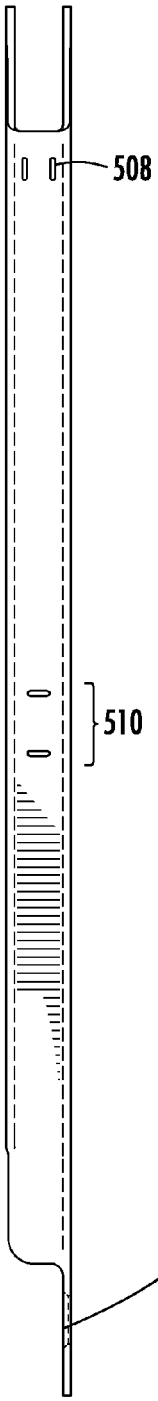
Figure 8:
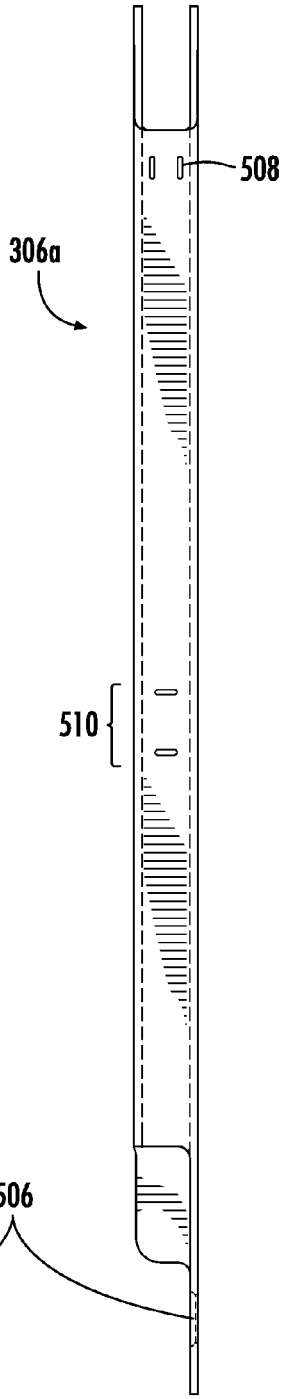

The arrangement, construction, and formation of uprights 306 is described with reference to upright 306*a* although those of ordinary skill in the art should understand that upright 306*b* is a mirror image of upright 306*a* and is thus formed and used in substantially the same manner. Referring to FIGS. 4 and 5, upright 306*a* is formed from a continuous piece 500 of tubular metal. Continuous piece 500 of tubular metal is butterflied, notched, lasered, or otherwise cut at locations 502 and 504 at the distal ends of piece 500 as illustrated in FIG. 5. Area 502 is configured to receive and connect to an end of a handrail, such as handrail 224 (FIG. 2). Area 504 is configured to connect to both support tread 304 (FIG. 3) and a support structure of a gangway, such as underbody 208 (FIG. 2). Additionally, continuous piece 500 of tubular metal is cut to define an aperture 506 configured to receive a connecting device, such as a bolt or rivet, in order to connect the upright to the support tread and the support structure. In another embodiment, the connecting device is a cross tube that extends through aperture 506 of upright 306*a* through the interior of tread support 304 and through aperture 506 of upright 506*b* on the other side. The cross tube is then welded at the connection of the cross tube, upright 306, and tread support 304. The shape of area 504 and the connecting device allow seatainer tread 300 (FIG. 3) to rotate with respect to the support structure without interfering (or coming into contact) with the support structure. Continuous piece 500 of tubular metal is also notched or otherwise cut to define two sets of apertures 508 and 510, such that the sets of apertures are configured to receive portions of respective lateral posts 310 and 312 (FIG. 3) as described in more detail below. FIGS. 6, 7, and 8 illustrate upright 306*a* formed from continuous piece 500 of tubular metal.

Referring again to FIG. 3, those of ordinary skill in the art will appreciate that upright 306*b* is a mirror image of upright 306*a*. Upright 306*b* may be connected to and used on the opposite side of seatainer tread 300 with respect to upright 306*a*. In contrast, uprights 308*a* and lateral posts 310*a* and 312*a* are identical to upright 308*b* and lateral posts 310*b* and 312*b*, respectively, so that each may be used on either side of seatainer tread 300.

Figure 9:
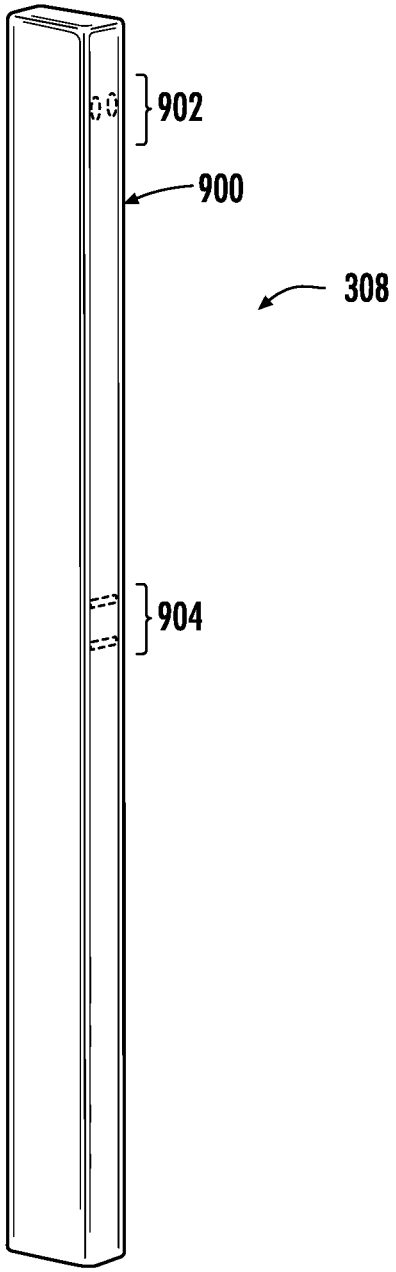
FIG. 9 is a perspective view of another upright of the seatainer tread of FIG. 3.

FIG. 9 illustrates upright 308 formed from another continuous piece 900 of tubular metal. Continuous piece 900 of tubular metal is notched or otherwise cut so that upright 308 defines two sets of apertures 902 and 904 configured to receive portions of respective lateral posts 310 and 312 (FIG. 3) as described below.

Figure 10:
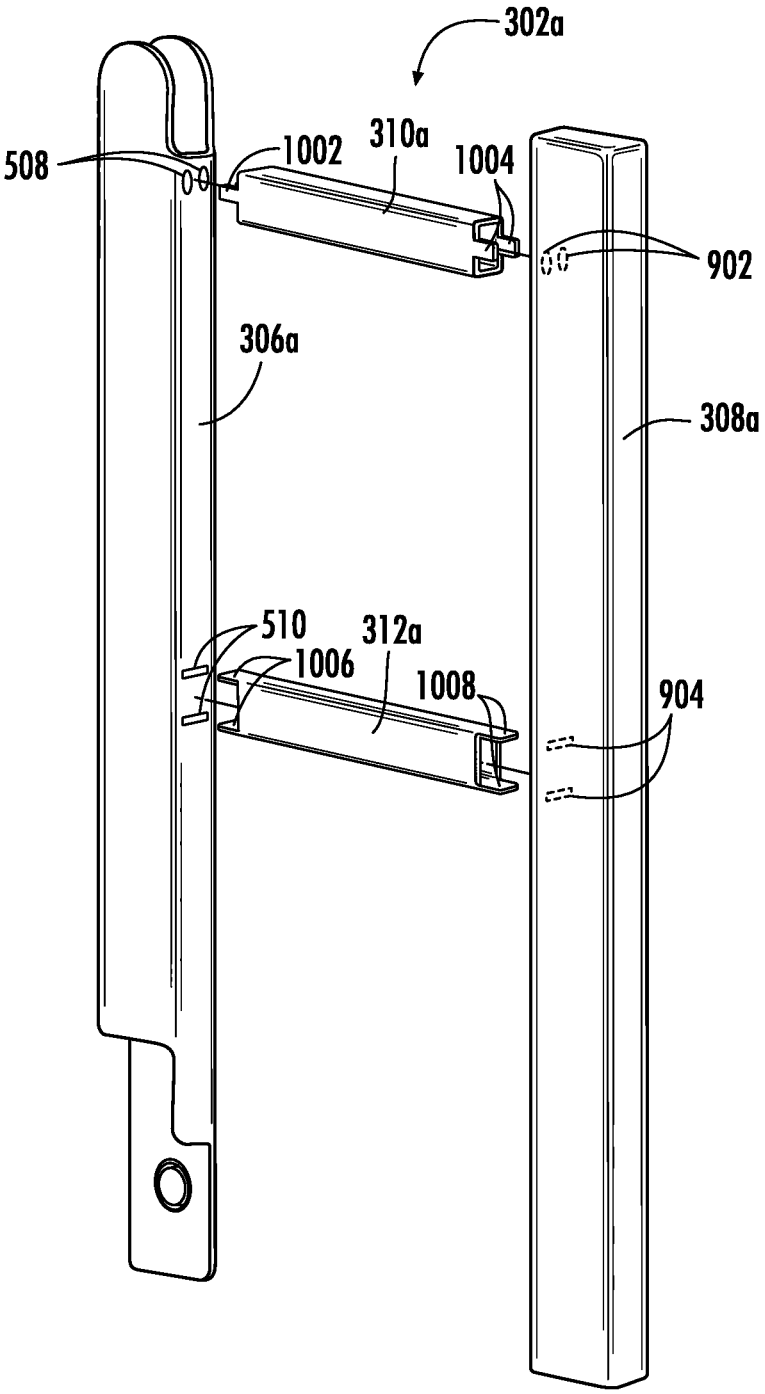
FIG. 10 illustrates the formation of a sidepost assembly of the seatainer tread of FIG. 3.

FIG. 10 illustrates the formation of handrail 302*a* comprising uprights 306*a* and 308*a* and lateral posts 310*a* and 312*a*. The ends of lateral post 310*a* define inserts or "tabs" 1002 and 1004 that extend laterally from the post. Similarly, the ends of lateral post 312*a* define inserts 1006 and 1008. Tabs 1002 of lateral post 310*a* are inserted into apertures 508 of upright 306*a*, and tabs 1004 of the post are inserted into apertures 902 of post 308*a*. Similarly, tabs 1006 of lateral post 312*a* are inserted into apertures 510 of upright 306*a*, and tabs 1008 are inserted into apertures 904 of upright 308*a*. Once connected, uprights 306*a* and 308*a* and lateral posts 310*a* and 312*a* may be welded and galvanized as desired. It should be understood by those of ordinary skill in the art that handrail 302*b* is formed in a similar manner. Handrails 302 are then connected to support tread 304 as described above.

Referring additionally to FIG. 3, it should be understood that the ends of lateral posts 310 (and/or lateral posts 312), including tabs 1002 and 1004, as well as apertures 508 and 902, may be formed so that lateral posts 310 (and/or lateral posts 312) exhibit an angled arrangement and so that upright 306 is lower than upright 308 with respect to a horizontal plane. This provides easier access to and use of handrails 302 when the corresponding gangway is oriented in a lowered position, as illustrated by gangway 200 in FIG. 2.

Figure 11:
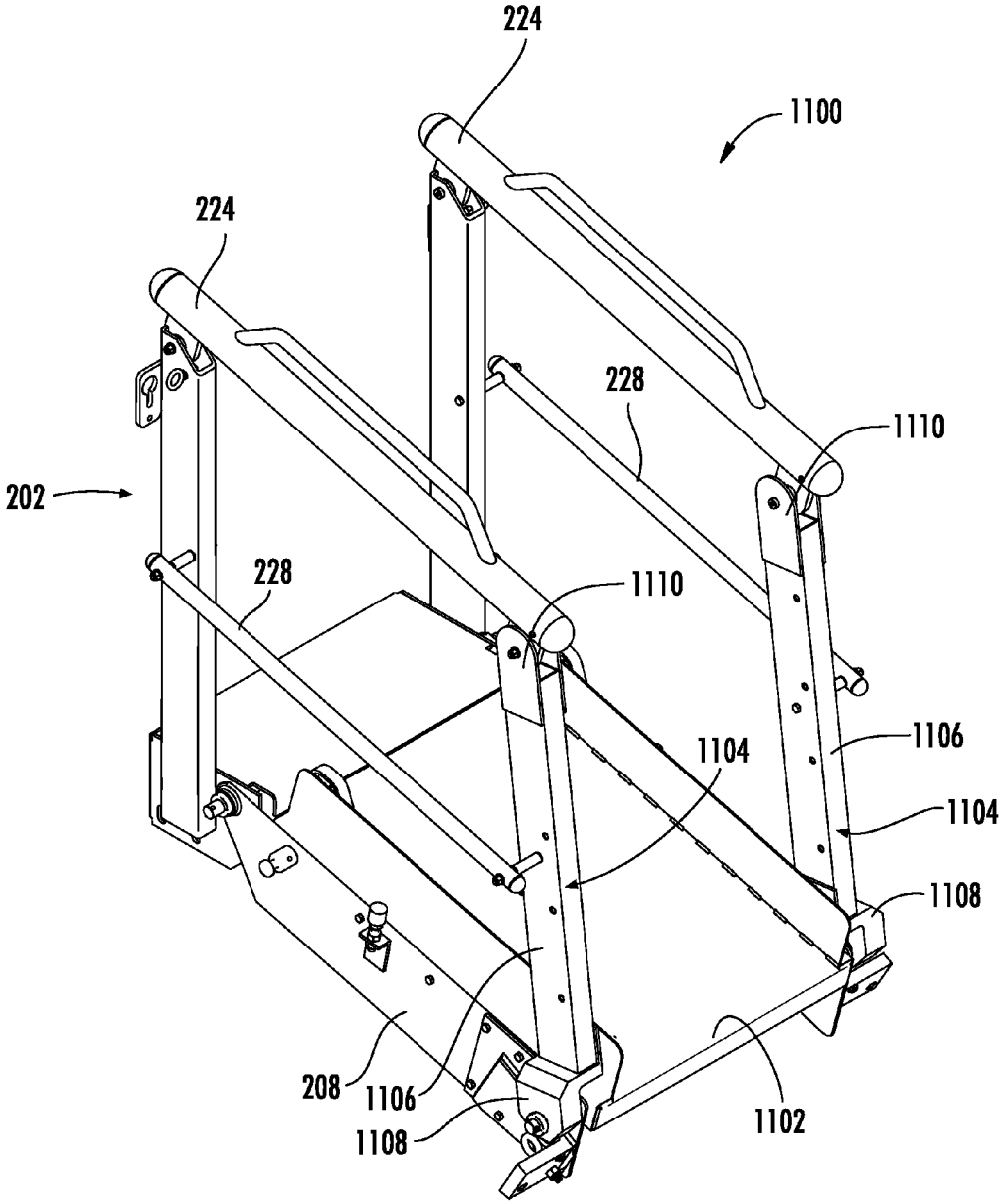
FIG. 11 is a perspective view of another gangway that may have been used in the system of FIG. 1.

FIG. 11 in a perspective view of a gangway 1100 that may be used as gangway 10 of FIG. 1. Among other elements, gangway 1100 comprises a ramp portion 1102, posts or "uprights" 1104, base tread 202, and support structure 208. Base tread 202 is pivotally connected to support structure 208 in a manner similar to that described above with respect to FIG. 2. Ramp portion 1102 is also connected to support structure 208. Uprights 1104 comprise tubular portions 1106 connected between bottom portions 1108, which are pivotally connected to ramp portion 1102, and top portions 1110, which are configured to receive portions of handrails 224. The pivotal connections between base tread 202 and support structure 208 and between the support structure and uprights 1104 allow ramp portion 1102 to rotate with respect to a fixed structure.

Top portions 1110 are formed by welding various pieces of metal and stock material together, which are drilled or otherwise cut prior to welding. Portions 1110 are then welded to lower portions 1108 in order to form upright 1104. As set forth above, manufacturing components for fall restraint equipment in such a manner is a protracted and costly process.

Figure 12:
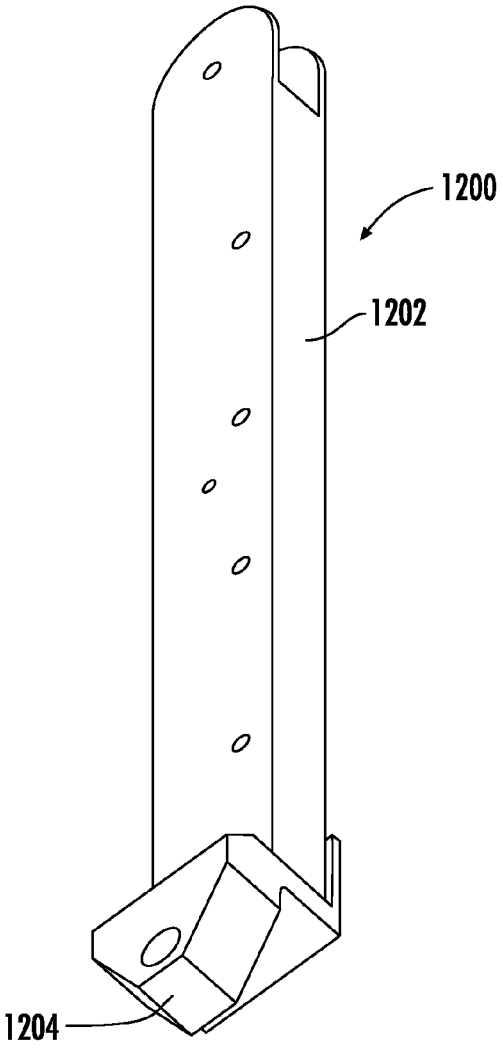
FIG. 12 is a perspective view of an upright of a ramp of a gangway in accordance with an embodiment of the present invention.
Figure 13:
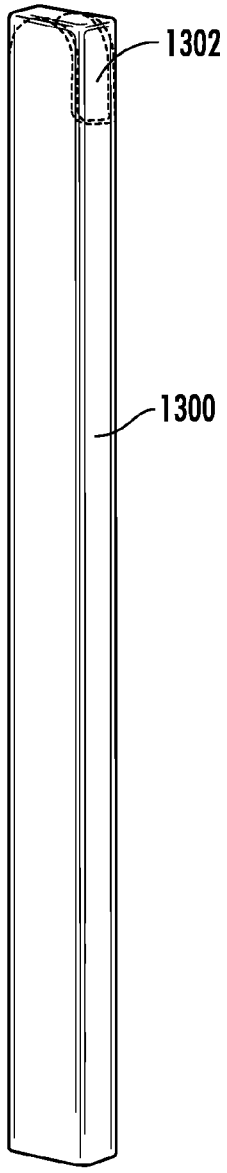
FIG. 13 illustrates the formation of a top portion of the upright of FIG. 12.
Figure 14:
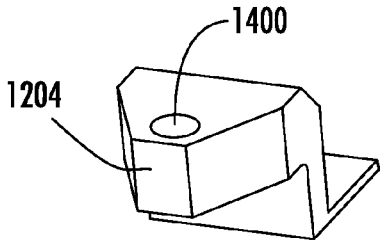
FIG. 14 is a perspective view of a bottom portion of the upright of FIG. 12.

FIG. 12 is a perspective view of an upright 1200, which may be substituted for uprights 1104 of gangway 1100 (FIG. 11). Upright 1200 comprises a post, tube, or "shaft" portion 1202 connected to a base portion 1204. FIG. 13 illustrates the formation of shaft portion 1202 from a continuous piece 1300 of tubular metal. Continuous piece 1300 of tubular metal is butterflied, notched, lasered, or otherwise cut at a distal end 1302 to form the area configured to receive a portion of a handrail, such as handrail 224 of FIG. 11. Referring to FIG. 14, base portion 1204 defines an aperture 1400. Referring to FIGS. 12, 13, and 14, shaft portion 1202 is welded to base portion 1204 in order to form upright 1200, which may then be galvanized if desired. Upright 1200 is then pivotally connected to a ramp of a gangway such as ramp portion 1102 of gangway 1100 (FIG. 11) via a rod, bar, bolt, or other suitable device passing through aperture 1400, the support structure, and the ramp.

Figure 15:
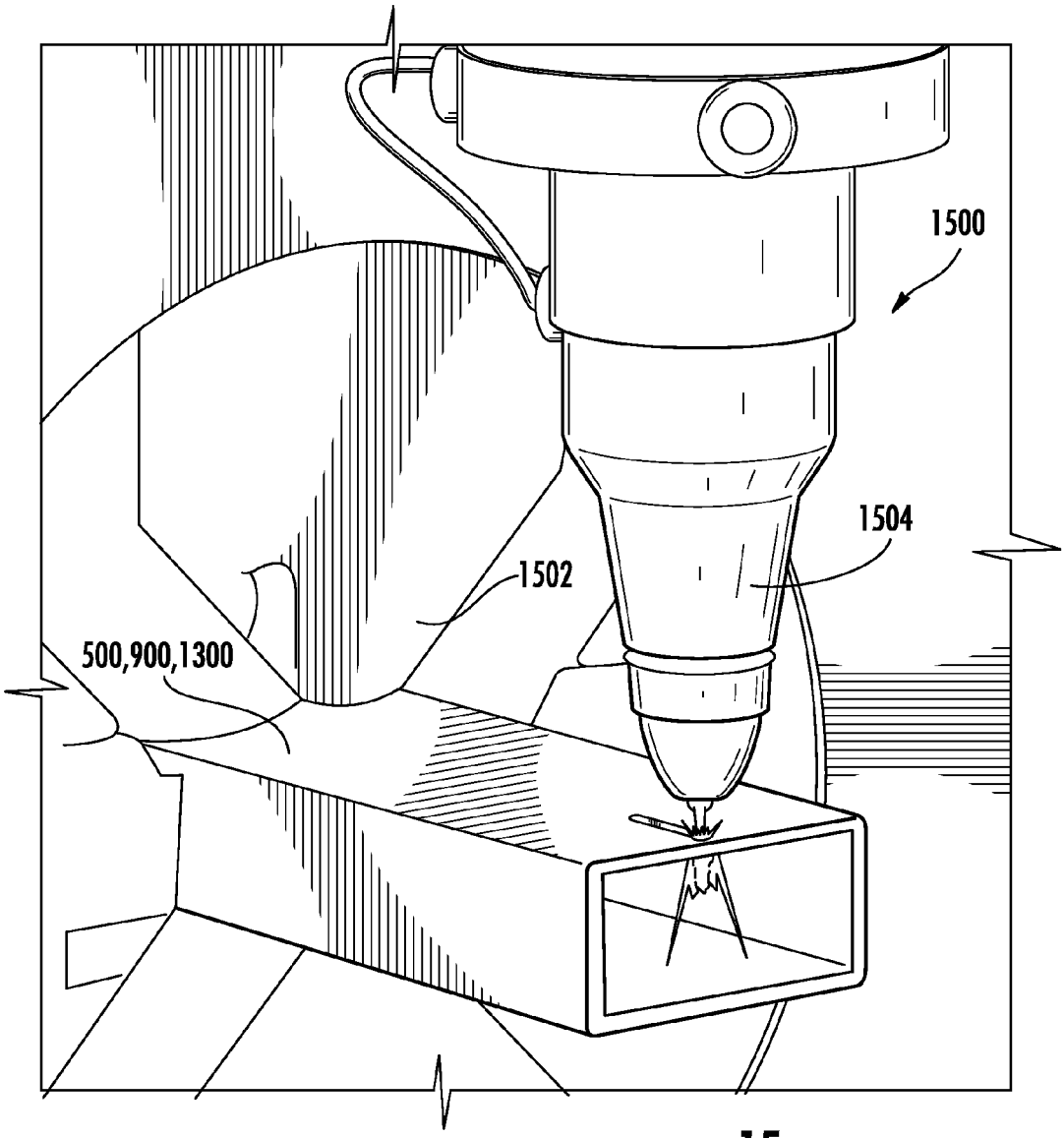
FIG. 15 illustrates an exemplary process for forming an upright in accordance with an embodiment of the present invention.

Referring to FIG. 15, a tube laser 1500 may be used to laser or otherwise cut continuous pieces 500, 900, and 1300 of tubular metal in order to form uprights 306, 308, and 1200, respectively. Each of continuous pieces 500, 900, and 1300 of metal is inserted into a holding mechanism 1502 of the tube laser, which moves and rotates the continuous piece while a $C0_2$ laser 1504 penetrates the metal. Tube laser 1500 further comprises a processor and a processor-readable medium containing computer instructions that, when executed by the processor, perform the function of providing a graphical user interface ("GUI"). The GUI allows a user to provide tube laser 1500 with the desired dimensions of continuous piece 500 of metal and the location and dimensions of the portions of the piece that need to be cut and removed in order to form uprights 306, 308, and 1200. Based on these instructions provided by the user, which are stored on the processor-readable medium, the processor instructs tube laser 1500, and more specifically, holding mechanism 1502 and laser 1504, how to rotate, move, and cut each continuous piece of metal. It should be understood that other suitable processes may be utilized to cut the continuous pieces of metal to form the uprights, including the use of a cutting drill, screw machine, mill, saw, or handheld plasma or flame torch. It should be understood by those of ordinary skill in the art that lateral posts 310 and 312 may be constructed in a similar manner. For instance, two tubular pieces of metal may be lasered or cut in order to define tabs and inserts 1002, 1004, 1006, and 1008 of respective posts 310 and 312.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

The invention claimed is:

1. A method for assembly of a gangway having at least one handrail and a support, the method comprising:

providing a first upright post produced from a first continuous piece of tubular metal by cutting a top portion of the first continuous piece of tubular metal to define a first flange and a second flange such that the first flange and second flange are an integral portion with the first upright post and such that the upright post is formed completely from the first continuous piece of metal, wherein the first flange and the second flange extend entirely along a longitudinal axis of said first continuous piece of tubular metal and define a first area located between the first and second flanges that is configured to receive a portion of the at least one handrail;

connecting the portion of the at least one handrail to the first upright post between the first flange and the second flange such that the handrail and upright post are pivotally connected at a point located within the longitudinal extent of the first continuous piece of tubular metal, and in a manner that allows the at least one handrail to rotate with respect to the first continuous piece of tubular metal;

connecting the first upright post to a first side of the support.

2. The method of claim 1 further comprising galvanizing the first upright post.

3. The method of claim 1 wherein the first upright post defines a first bottom area configured to connect to the support, said first bottom area formed by cutting a bottom portion of the first continuous piece of tubular metal.

4. The method of claim 1, wherein the gangway further comprises another handrail, the method further comprising:

providing a third upright post;

connecting the third upright post to the first side of the support;

providing a second upright post produced from a second continuous piece of tubular metal by cutting a top portion of the second continuous piece of tubular metal to define a third flange and a fourth flange, wherein the third flange and the fourth flange define a second area located between the third and fourth flanges configured to receive a portion of the another handrail;

connecting the portion of the another handrail to the second upright post between the third flange and the fourth flange in a manner that allows the another handrail to rotate with respect to the second continuous piece of tubular metal;

connecting the second upright post to a second side of the support;

providing a fourth upright post; and connecting the fourth upright post to the second side of the support.

5. The method of claim 4 wherein the second upright post defines a second bottom area configured to connect to the support, said second bottom area formed by cutting a bottom portion of the second continuous piece of tubular metal.

6. The method of claim 1 further comprising:

providing a support bar;

providing an additional upright post; and connecting said additional upright post to the first side of the support such that the support bar interconnects the first upright post and the additional upright post.

7. The method of claim 6 further comprising galvanizing the first upright post, the support bar, and the additional upright post.

8. The method of claim 6 wherein the support bar is formed from a continuous piece of tubular metal.

9. The method of claim 1 wherein the first upright post is fixedly connected to the first side of the support.

10. The method of claim 9 wherein the first upright post is fixedly connected to the first side of the support by welding.

11. The method of claim 1 wherein the support is a seatainer tread support.

12. A seatainer tread for a gangway comprising:

a tread support for supporting a user;

a first upright post comprising a first continuous piece of tubular metal connected to a rear portion of a first side of the tread support, a top portion of the first continuous piece of tubular metal is cut to define a first flange and a second flange such that the first flange and second flange are an integral portion with the first upright post, wherein the first flange and the second flange extend entirely along a longitudinal axis of said first continuous piece of tubular metal such that a first handrail and the first upright post are pivotally connected at a point located within the longitudinal extent of the first continuous piece of tubular metal, and wherein the first flange and the second flange define a first area between the first flange and the second flange that is configured to receive a portion of the first handrail of the gangway;

a second upright post comprising a second continuous piece of tubular metal connected to a rear portion of a second side of the tread support, wherein a top portion of the second upright post defines a third flange and a fourth flange such that the third flange and fourth flange are an integral portion with the second upright post, wherein the third flange and the fourth flange extend entirely along a longitudinal axis of said second continuous piece of tubular metal such that a second handrail and the second upright post are pivotally connected at a point located within the longitudinal extent of the second continuous piece of tubular metal, and wherein the third flange and the fourth flange define a second area between the third flange and the fourth flange that is configured to receive a portion of the second handrail of the gangway;

a third upright post connected to a front portion of the first side of the tread support, wherein the third upright post is connected to the first upright post via a first support bar; and a fourth upright post connected to a front end of the second side of the tread support, wherein the fourth upright post is connected to the second upright post via a second support bar.

13. The seatainer tread of claim 12 wherein the first continuous piece of tubular metal comprises a bottom portion cut to define a first bottom area configured to connect to the tread support.

14. The seatainer tread of claim 12 wherein the third upright post comprises a third continuous piece of tubular metal.

15. The seatainer tread of claim 14 wherein the fourth upright post comprises a fourth continuous piece of tubular metal.

16. The seatainer tread of claim 14 wherein:

the first continuous piece of tubular metal defines at least one aperture configured to receive a first end of the first support bar; and the third continuous piece of tubular metal defines at least one aperture configured to receive a second end of the first support bar.

17. The seatainer tread of claim 16 wherein the seatainer tread is galvanized.

18. The seatainer tread of claim 12 wherein the first and second upright posts are fixedly connected to the first and second sides of the tread support, respectively.

19. The seatainer tread method of claim 18 wherein the first and second upright posts are fixedly connected to the tread support by welding.

20. A gangway comprising:

an underbody having a first side and a second side interconnected by a middle section, wherein the first side and second side define relatively parallel planes opposite one another with respect to the middle section;

a support, wherein a first side of the support is rotatably connected to the first side of the underbody and a second side of the support is rotatably connected to the second side of the underbody;

an upright post fixedly connected to the first side of the support, wherein the connection of the upright post, the support, and the underbody defines a pivot axis about which the support and the upright post can pivot, wherein the upright post comprises a first continuous piece of metal, a top portion of the first continuous piece of metal defines a first flange and a second flange, wherein the first flange and second flange extend integrally and entirely along a longitudinal axis of said first continuous piece of metal and define a first area located between the first flange and the second flange; and a handrail connected to the upright post, wherein a portion of the handrail is received within the first area and pivotally connected to the first flange and the second flange at a point located within the longitudinal extent of the first continuous piece of tubular metal.

21. The gangway of claim 20 wherein the support is a tread.

22. The gangway of claim 20 further comprising:

a second upright post fixedly connected to the second side of the support, wherein the connection of the second upright post, the support, and the underbody is situated at the pivot axis, wherein the second upright post comprises a second continuous piece of metal, a top portion of the second continuous piece of metal defines a third flange and a fourth flange, wherein the third flange and fourth flange extend integrally along a longitudinal axis of said second continuous piece of metal and define a second area located between the third flange and the fourth flange; and a second handrail connected to the second upright post, wherein a portion of the second handrail is received within the second area and pivotally connected to the third flange and the fourth flange.

* * * * *

UNITED STATES PATENT AND TRADEMARK OFFICE

CERTIFICATE OF CORRECTION

PATENT NO. : 8,782,838 B2
APPLICATION NO. : 12/487408
DATED : July 22, 2014
INVENTOR(S) : Honeycutt et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 84 days.

Signed and Sealed this
Eighth Day of March, 2016

Michelle K. Lee

Michelle K. Lee
*Director of the United States Patent and Trademark Office*